US012091201B2

(12) United States Patent
Seok

(10) Patent No.: US 12,091,201 B2
(45) Date of Patent: Sep. 17, 2024

(54) TRIPLE CENTER SEALING DEVICE IN PILLOW PACKAGING MACHINE

(71) Applicant: HYUNJIN CO., LTD., Ansan-si (KR)

(72) Inventor: Mong Peel Seok, Anyang-si (KR)

( * ) Notice: Subject to any disclaimer, the term of this patent is extended or adjusted under 35 U.S.C. 154(b) by 212 days.

(21) Appl. No.: 17/754,137

(22) PCT Filed: Sep. 22, 2020

(86) PCT No.: PCT/KR2020/012764
§ 371 (c)(1),
(2) Date: Mar. 24, 2022

(87) PCT Pub. No.: WO2021/060798
PCT Pub. Date: Apr. 1, 2021

(65) Prior Publication Data

US 2022/0289414 A1 Sep. 15, 2022

(30) Foreign Application Priority Data

Sep. 26, 2019 (KR) ..... 10-2019-0118976

(51) Int. Cl.
*B65B 41/16* (2006.01)
*B65B 51/16* (2006.01)
(Continued)

(52) U.S. Cl.
CPC ..... *B65B 51/26* (2013.01); *B65B 41/16* (2013.01); *B65B 51/16* (2013.01); *B65B 61/08* (2013.01)

(58) Field of Classification Search
USPC ..... 53/548
See application file for complete search history.

(56) References Cited

U.S. PATENT DOCUMENTS 5,868,901 A * 2/1999 Smith ..... B29C 66/81435 156/515
6,155,030 A * 12/2000 Inoue ..... B29C 66/0324 53/374.3

(Continued)

FOREIGN PATENT DOCUMENTS

JP 3023114 U 4/1996
JP 2004-035084 A 2/2004

OTHER PUBLICATIONS

WO/ISR issued in PCT/KR2020/012764 on Dec. 17, 2020.
Japanese Office Action issued in 2022-519405 on Feb. 7, 2023.

*Primary Examiner* — Chinyere J Rushing-Tucker
(74) *Attorney, Agent, or Firm* — Fresh IP PLC; Andrew Berks

(57) ABSTRACT

The present invention relates to a triple center sealing device in a pillow packaging machine. To this end, the present invention comprises: a plurality of film supply rollers (110) which are provided on one side of a pillow packaging machine (100), and unwind a roll film (P) to supply the same to one side; a guide former (120) which is provided in the pillow packaging machine (100) and functions to tightly roll and wrap the film (P), being conveyed to the one side in an unwound state by the film supply rollers (110), so as to fit the size of a product; a sealing section pleating unit (150) which is provided at the front of the pillow packaging machine (100), and operates by being driven by a driving unit (160) so as to allow a sealing section of the film to be automatically overlapped in a multiple Z-shape, thereby enabling a packaging process to be performed without defects; and a cutting roller (140) which is provided on the other side of the pillow packaging machine (100), and cuts and seals packaging paper that is discharged. According to the present invention having the configuration described above, a center sealing section of the film is bonded after being overlapped (Continued)

three times (double layers×3), and thus the packaging can be performed without defects. Accordingly, the quality and reliability of the sealing device can be significantly improved, and thus various desires (needs) of manufacturers can be satisfied to make a good impression.

4 Claims, 12 Drawing Sheets

(51) Int. Cl.
*B65B 51/26* (2006.01)
*B65B 61/08* (2006.01)

(56) References Cited

U.S. PATENT DOCUMENTS

2001/0010253 A1 8/2001 Forman
2004/0194429 A1 10/2004 Schneider et al.

* cited by examiner

TRIPLE CENTER SEALING DEVICE IN PILLOW PACKAGING MACHINE

CROSS REFERENCE TO RELATED APPLICATION

This application claims the benefit of priority to Korean Non-Provisional Patent Application No. 10-2019-0118976 filed on Sep. 26, 2019, the entire contents of which being incorporated herein by reference.

FIELD OF THE DISCLOSURE

The present disclosure relates to a pillow type packaging machine for sealing triply a center portion of a film; and more particularly relates to the pillow type packaging machine for sealing the center portion of the film three times with double layers that results in six layers, so that the packaging is done without defect. This enhances a reliability and a quality of the pillow type packaging machine, thereby satisfying various needs of product manufacturers and giving them a good impression of the pillow type packaging machine.

BACKGROUND OF THE DISCLOSURE

As is well known, in order to automatically pack various types of manufactured products, you may put or collect certain amount of the products already packaged in base units and make the base units approach a packaging machine such as a box taper, a band sealer, or a tying machine.

In addition, packaging methods such as 3-side sealing, 4-side sealing, pillow type packaging, shrink packaging, vacuum packaging, filler packaging and the like may be used when a single product or a small amount of products is packaged by using resin films. Herein, the resin films may be PP, PE, OPP, BOPP, HDPE, LDPE etc. Thanks to these countless forms and methods of packaging, we humans have enjoyed a very convenient daily life.

Among these countless forms and methods of packaging, the present disclosure is limited to an automatic pillow type packaging machine. In detail, the present disclosure is related to sealing a center portion of a film without having a relation to sealing upper and lower portions.

Until now, pillow type packaging machines are mainly used for food product packaging. In this case, laminated thick films (e.g., OPP+PE→40 μ+30μ=70 μmm film thickness) are used for hygiene and health reasons. Using the laminated thick films may not cause most of the packaging problems during distribution.

However, in case of non-food products (e.g., paper cups) which are disposable and have low profit due to their low unit prices, only the packaging material that is as thin and inexpensive as possible could be used.

Therefore, HDPE, i.e., High Density Polyethylene, whose thickness of about 10 μm has been used since 1997 when suitable automatic packaging machines began to be popular in Korean paper cup industry. Unfortunately, thin HDPE had a lot of problems to be used with conventional automatic pillow type packaging machines. Thus, vertical L-sealer type packaging machines have been adopted and distributed in the Korean paper cup industry.

But, due to the space occupied by a sealing bars (cutters) of the L-sealer type packaging machines, the L-sealer type packaging machines inevitably had loose packaging, which led to excessive consumption of the packaging film as well as negative effect on the appearance of package.

At the same time, a thin film around a thickness of 10 μm, which is a desired thickness for a conventional pillow type packaging machines in the related industry due to cost reduction, induced following problems as well.

That is, as illustrated in FIGS. 1 and 2, the prior art has a problem that a very end of an edge of a sealing of the package is long at one side, while the other very end of the edge of the sealing of the package is protruded. This spoils the appearance of the package and causes the package to be easily torn or burst thereby providing defects (This does not occur on regular food packages, but occur on thin films such as paper cup packages).

Especially, the prior art has another problem in that since the sealing of the center portion of the film is not done with triple stacked zig-zag shapes, a probability of defective packaging is high, leading to a degradation in work efficiency.

Also, the prior art has yet another problem that the film is easily torn or melted and burst due to overheating, when using thin film.

Further, the prior art has still yet another problem that it is not possible to maintain good sealing condition without surplus and deviation of the film.

Furthermore, the prior art has still yet another problem that the tight sealing cannot be completed with the thin film.

Thus, the prior art has still yet another problem that production cost of the paper cup package cannot be reduced due to the unavailability of the thin film.

Although the following background patent documents have been developed to solve the problems above, there are still problems that could not be solved with the background patent documents at once.

(Patent document 1) KR patent publication No. 2013-0019787 (Feb. 27, 2013) has been disclosed.

(Patent document 2) KR patent publication No. 2016-0101776 (Aug. 26, 2016) has been disclosed.

(Patent document 3) KR patent publication No. 2017-0063272 (Jun. 8, 2017) has been disclosed.

(Patent document 4) KR patent registration No. 1979660 (May 13, 2019) has been disclosed.

SUMMARY OF THE DISCLOSURE

The present disclosure was invented to solve the problems of the prior art as described above, by providing a pillow type packaging machine for sealing triply a center portion of a film. The first objective of the present disclosure is to provide a guide former, a plate and a wrinkles forming part which forms wrinkles on the center portion of the film. The second objective of the present disclosure is to make the sealing of the center portion of the film being automatically stacked with multiple (especially triple) zig-zag shapes, thereby carrying out a packaging operation without defect. The third objective of the present disclosure is to maintain a good sealing condition while using a thin film. The fourth objective of the present disclosure is to maintain a good sealing condition without surplus and deviation of the film. The fifth objective of the present disclosure is to prevent the film from tearing or bursting by maintaining a good sealing condition of the film. The sixth objective of the present disclosure is to complete tight sealing of the package in spite of using the thin film. The seventh objective of the present disclosure is to greatly reduce a production cost of the paper cup package by using the thin film. The eighth objective of the present disclosure is to ensure that shapes of the sealed center portion are identical by sealing the center portion so that there is no defect. The ninth objective of the present disclosure is to enhance a reliability and a quality of the pillow type packaging machine, thereby satisfying various needs of product manufacturers and giving them a good impression of the pillow type packaging machine.

Technical Solution for the Object of the Disclosure

The present disclosure provides a pillow type packaging machine for sealing triply a center portion of a film P, which automatically packages products, the pillow type packaging machine comprising: a plurality of film supply rollers, located at an input end of the pillow type packaging machine, which unwind the roll film P and transport the unwound roll film P; a guide former which receives the unwound roll film P from the film supply rollers and tightly rolls and wraps the film P to fit sizes of the products; a wrinkles forming part which receives the film P from the guide former and is operated by driving a driving part such that the center portion of the film P is automatically stacked with multiple zig-zag shapes to form wrinkles on the center portion of the film P, thereby carrying out a packaging operation without defect; and cutting rollers, located at an output end of the pillow type packaging machine, which cut packages discharged after the wrinkles are formed on the center portion of the film P, while sealing the packages.

Technical Advantage of the Disclosure

As described above, the present disclosure was invented to provide a guide former, a plate and a wrinkles forming part which forms wrinkles on a center portion of a film.

The present disclosure makes the sealing of the center portion of the film being automatically stacked with triple zig-zag shapes, thereby carrying out a packaging operation without defect.

Also, the present disclosure maintains a good sealing condition without tear of a thin film (thickness of about 10 μmm).

Further, the present disclosure prevents surplus of the sealing of the film to make the appearance of the sealing decent.

Furthermore, the present disclosure prevents the film from tearing or bursting in spite of using the thin film.

Especially, the present disclosure allows complete tight sealing of the package in spite of using the thin film, by sealing triply the center portion of the film so that the adhesive part of the sealing of the center portion does not widen a gap although a temperature of the sealing rollers is low.

Thus, the present disclosure enables to use the thin film with narrow width which cannot be used in general packaging machines, thereby achieving a reduction on the production cost.

The present disclosure is a greatly useful disclosure, since it enhances the reliability and the quality of the pillow type packaging machine, thereby satisfying various needs of product manufacturers and giving them a good impression of the pillow type packaging machine.

Hereinafter, preferred embodiments of the present disclosure for achieving the advantages described above will be described in detail with reference to the attached drawings.

DETAILED DESCRIPTION OF THE PREFERRED EMBODIMENTS

Figure 1:
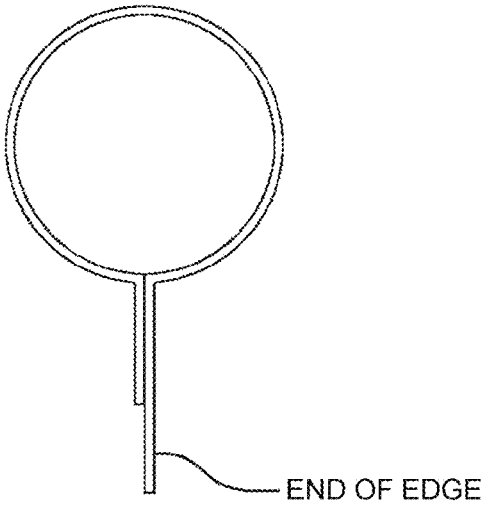
FIG. 1 (PRIOR ART)
FIG. 1 represents a cross-sectional configuration showing a conventional product package.
Figure 2:
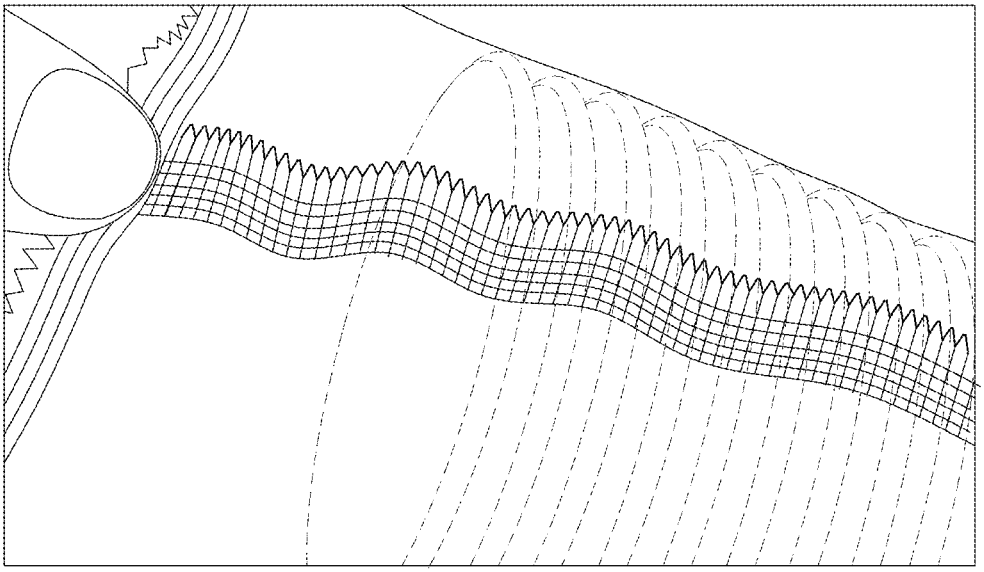
FIG. 2 (PRIOR ART)
FIG. 2 is a picture of the conventional product package.

A pillow type packaging machine for sealing triply a center portion of a film of the present disclosure is configured as shown in FIGS. 3 to 10.

In describing the present disclosure, when detailed descriptions of related known functions or configurations are determined to unnecessarily obscure the subject matter of the present disclosure, the detailed descriptions thereof will be omitted.

And since the terms described below are set in consideration of functions in the present disclosure and may vary depending on the intention of a manufacturer or a convention, the definition of the terms should therefore be based on the overall description of the present specification.

In addition, since the sizes and thicknesses of each component shown in the drawings are arbitrarily shown for convenience of explanation, the present disclosure is not necessarily limited to those illustrated in the drawings.

Firstly, all films that can be thermally bonded are available for a pillow type packaging operation for the present disclosure. However, smaller elongation of the film is mechanically advantageous. PE, which has a higher elongation and is slippery compared to other films such as PP, PET, OPP, HDPE, has a problem that it has an inconsistent thickness compared to other films thereby being difficult to match left and right ends of packaging equally. The present disclosure solves this problem.

In order to solve the problem above, the present disclosure comprises a plurality of film supply rollers 110, located at an input end of the pillow type packaging machine 100, which unwind the roll film P and transport the unwound roll film P.

Also, the present disclosure comprises a guide former 120 which receives the unwound roll film P from the film supply rollers 110 and tightly rolls and wraps the film P to fit sizes of the products.

Herein, a guide plate 121 protruding from a bottom surface of the guide former 120 collects the left and right sides of the rolled film P and transports the film P.

Further, the present disclosure comprises a wrinkles forming part 150 which receives the film P from the guide former 120 and is operated by driving a driving part 160 such that the center portion of the film P is automatically stacked with multiple (especially triple) zig-zag shapes to form wrinkles on the center portion of the film P, thereby carrying out a packaging operation without defect.

Herein, the driving part 160 is driven such that pulling rollers and sealing rollers operate.

In addition, the present disclosure comprises cutting rollers 140, located at an output end of the pillow type packaging machine 100, which cut packages discharged after the wrinkles are formed on the center portion of the film P, while sealing the packages.

Especially, a configuration of the wrinkles forming part 150 is described below.

Figure 5:
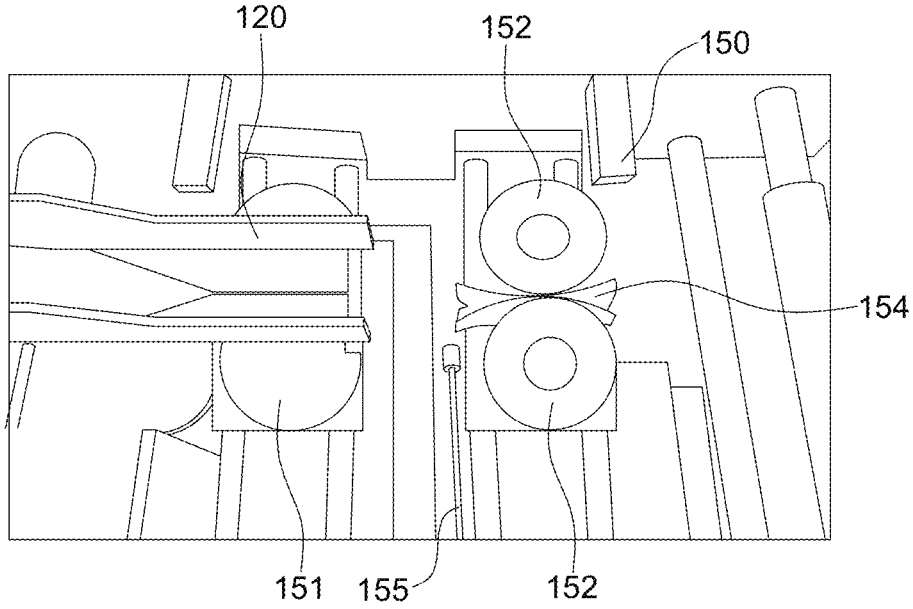
FIG. 5 is a picture of a wrinkles forming part of the present disclosure with a plate removed.

That is, the wrinkles forming part 150 of the present disclosure comprises a pair of puling rollers 151 which tightly wraps the products to be packaged while pulling the received film P downwards (see FIG. 5).

Also, the wrinkles forming part 150 of the present disclosure comprises a pair of sealing rollers 152 which receives the film P from the pair of pulling rollers 151 and bonds a lower part of the center portion of the film P while transporting the film P, wherein the pair of sealing rollers 152 is provided with a pair heaters 153 at a lower part thereof.

Herein, the guide former 120 which rolls the unwound roll film P to be easily packaged and transports the unwound roll film P is provided at an entrance of the wrinkles forming part 150.

Also, a plate 130 which serves as a cover to protect parts of the wrinkles forming part 150 is provided at an upper part of the wrinkles forming part 150.

Herein, a film collecting part 132 which collects and discharges the transported film P is provided at the plate 130.

Preferably, a pair of walls 131 which safely guides and transports the product is provided at two sides of the upper part of the plate 130.

In addition, the pair of puling rollers 151 are inclined downwards in order to tightly wrap the products while pulling the film P downwards.

Further, a height of a contact point between the pair of sealing rollers 152 is higher than a height of a contact point between the pair of pulling rollers 151, and preferably the pair of sealing rollers 152 is positioned horizontally such that the triply sealed center portion is prevented from disengaging from the contact point between the pair of sealing rollers 152.

As described above, triple wrinkles are formed on the film by a difference of a height between a center of the pair of pulling rollers 151 and an upper contact point of the pair of sealing rollers 152. During this process, an operator may adjust a degree of forming the wrinkles by operating a center portion shape adjusting key 155.

Herein, preferably the pair of puling rollers 151 may be inclined downwards by about 10 to 20 degrees in order to tightly wrap the products (in this case, paper cups) while pulling the film P downwards.

In addition, the wrinkles forming part 150 of the present disclosure further includes a heat-resistant film protecting member 154 in between the pair of sealing rollers 152, wherein the heat resistant film protecting member 154 facilitates transportation of the film P and protects the center portion of the film P from heat.

Figure 7A:
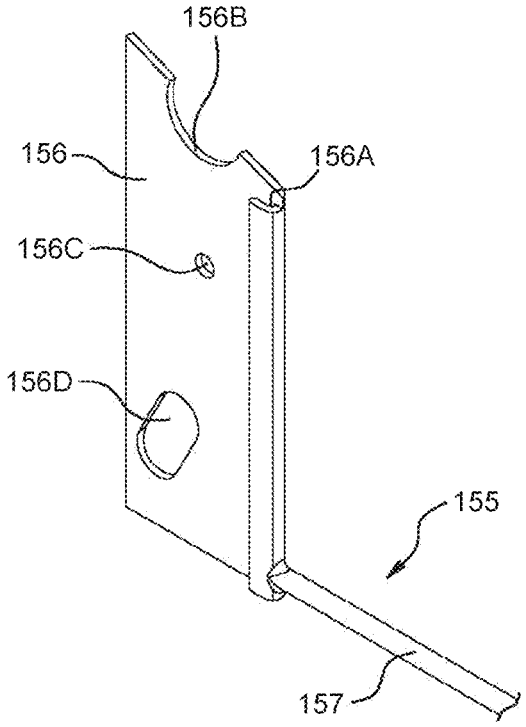
FIG. 7A is a perspective view of a first embodiment of a center portion shape adjusting key of the present disclosure.
Figure 7B:
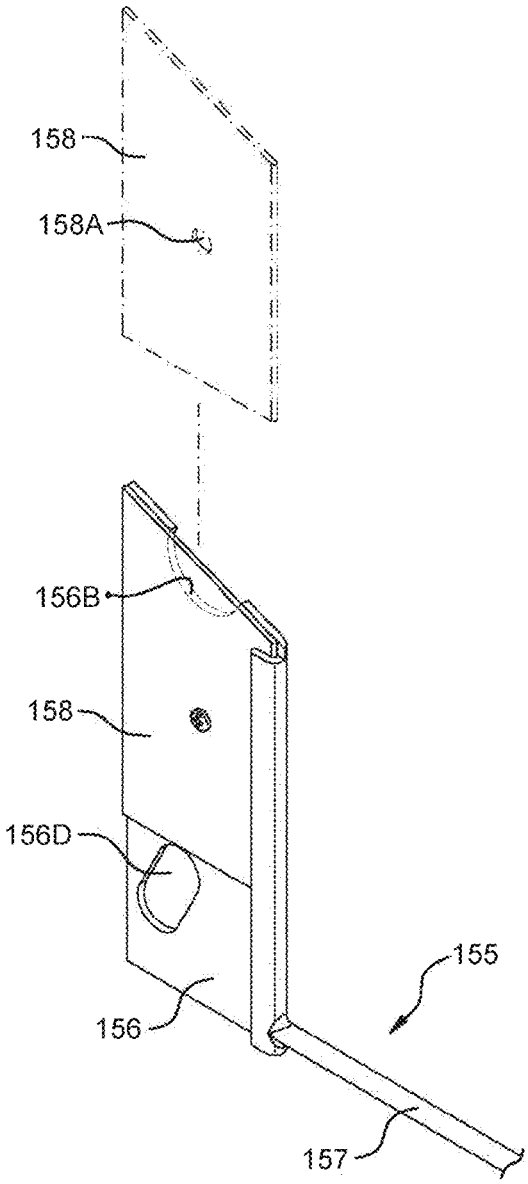
FIG. 7B is a perspective view of a second embodiment of the center portion shape adjusting key of the present disclosure.
Figure 7C:
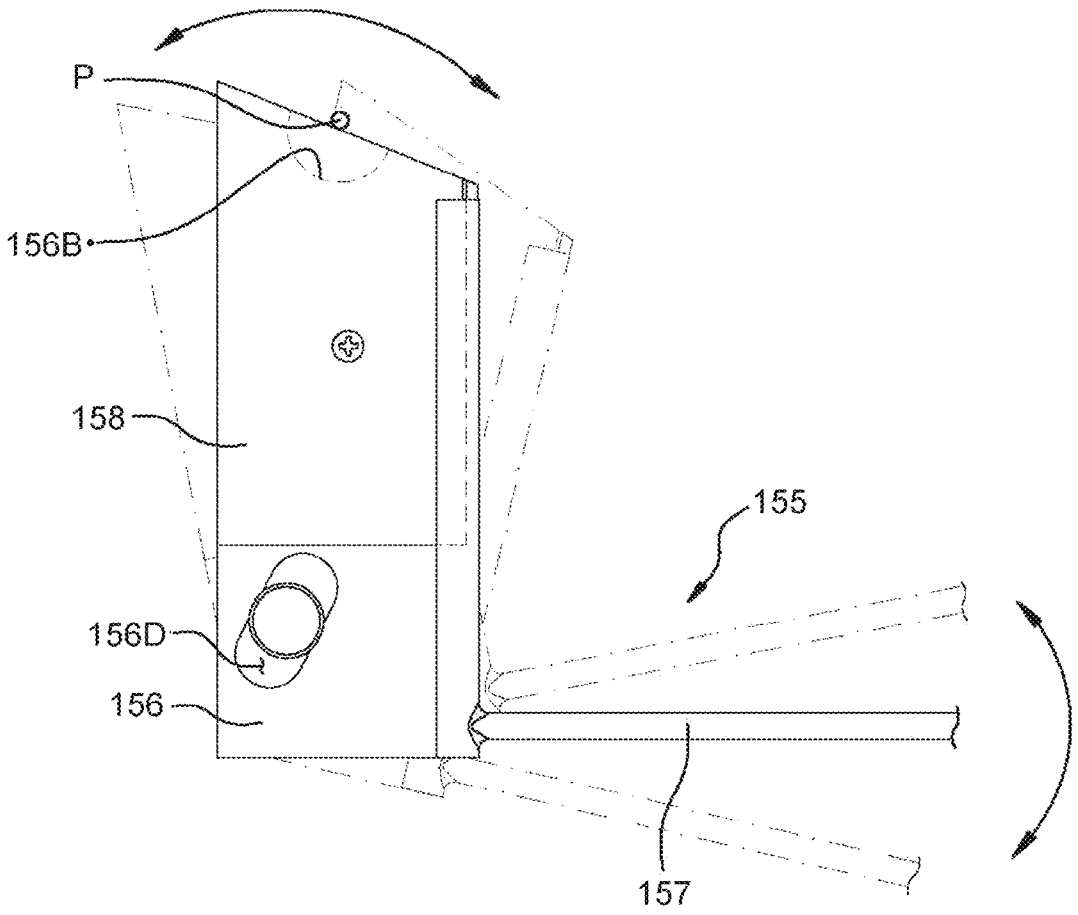
FIG. 7C illustrates an operation state of the center portion shape adjusting key of the present disclosure.

Also, the wrinkles forming part 150 of the present disclosure further includes: the center portion shape adjusting key 155 at an entrance of the pair of sealing rollers 152, wherein the center portion shape adjusting key 155 operates to adjust a height or an angle of a main body 156 or an auxiliary body 158 selectively around a rotatoinal axis inserted into a hole **156*d* according to an operation of a grip 157 such that the center portion shape adjusting key 155 contacts a lower surface of the film P and pushes the film P, thereby providing sealing on the center portion of the film P without defect (see FIG. 7**C).

Herein, FIG. 7A is a first embodiment of the center portion shape adjusting key 155 and FIG. 7B is a second embodiment of the center portion shape adjusting key 155 with auxiliary body 158 being inserted thereinto.

According to FIG. 7A, when the operator holds the grip 157 and rotates the main body 156 around a rotatoinal axis inserted into a hole **156*d*, wherein the hole is formed long to adjust the height and the angle of the shape adjusting key, multiple wrinkles are formed on the film while upper surface of the main body 156 is contacting with the lower surface of the film. Herein, a groove 156*b* which supports the film P to be transported constantly and uniformly is provided at the upper surface of the main body 156** which contacts with the lower surface of the film P.

Further, an auxiliary body fastening groove **156*a* is formed at one side of the main body 156 to allow the auxiliary body 158 to be inserted thereinto, and at least one fastening groove 156*c* into which a fastener is inserted is formed at the main body 156 to closely fix the auxiliary body 158**.

FIG. 7B illustrates the auxiliary body 158 without grooves that may be selectively coupled to the main body 156. When the fastening groove **158*a* of the auxiliary body 158 and the fastening groove 156*c* of the main body 156** are matched with each other, the auxiliary body may be tightly fixed to the main body. This enables the operator to adjust a degree of forming the wrinkles suitably.

Meanwhile, the present disclosure may be variously modified and may take various forms in applying the above-mentioned components.

And it should be understood that the present disclosure is not limited to the specific embodiments mentioned in the above detailed description, but rather includes all modifications, equivalents, and substitutes within the spirit and scope of the present disclosure defined by the appended claims.

The technical advantages of the pillow type packaging machine for sealing triply the center portion of the film of the present disclosure will be described below.

Firstly, the present disclosure makes the sealing of the center portion of the film being automatically stacked with triple zig-zag shapes, thereby carrying out a packaging operation without defect. Especially, sealing triply the center portion of the film prevents generating a gap on the sealing even without an exact temperature control. Also, when the automatic packaging process is temporarily suspended and intermittently operated due to inconstant supply of the products, the present disclosure prevents melting on the contacting point between the pair of sealing rollers by overheating. Further, the present disclosure prevents surplus of the sealing of the film to make the appearance of the sealing decent. Furthermore, the present disclosure enables to use thin package material (i.e., a thin film) with narrow width which cannot be used in general packaging machines, thereby achieving reduction on the production cost.

Figure 3:
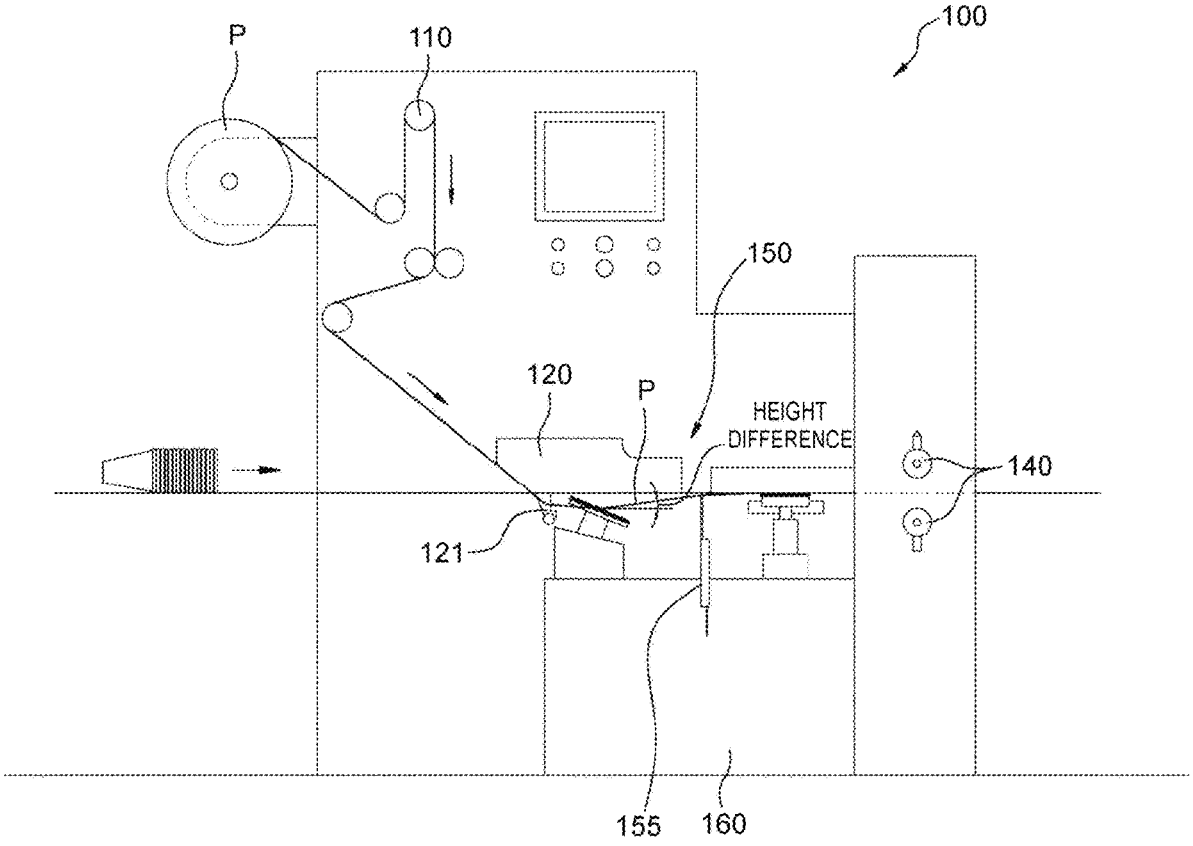
FIG. 3 shows a configuration of a pillow type packaging machine for sealing triply a center portion of a film.

FIG. 3 represents a configuration of the pillow type packaging machine for sealing triply the center portion of the film. After the product (i.e., the paper cup) is introduced through the input end of the pillow type packaging machine, an automatic packaging process is performed on the product and then the product is discharged through the output end of the pillow type packaging machine.

Figure 4:
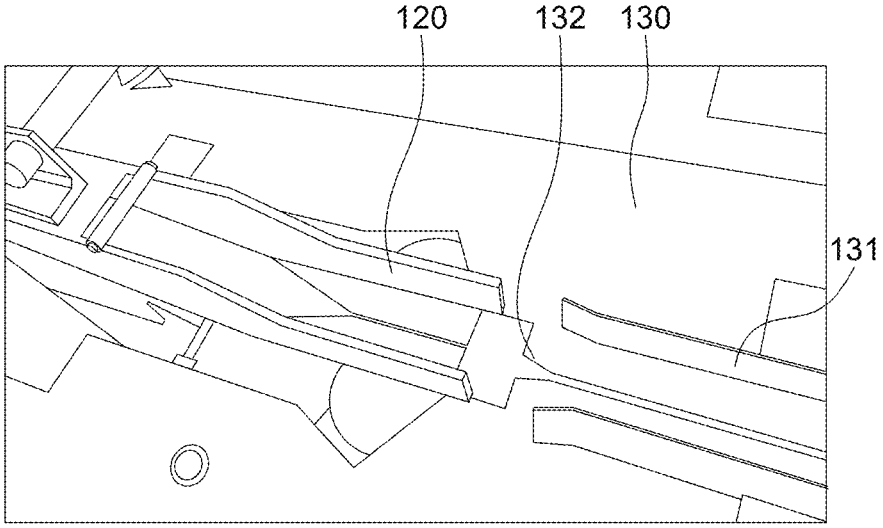
FIG. 4 is a picture of a guide former of the present disclosure.

FIG. 4 is a picture of the guide former 120 and the plate 130 attached to the wrinkles forming part 150 of the present disclosure.

Especially, the guide former 120 receives the unwound roll film P from the film supply rollers 110 and tightly rolls and wraps the film P to fit sizes of the products.

Herein, the guide plate 121 protruding from a bottom surface of the guide former 120 collects the left and right sides of the rolled film P and transports the film P. A lower left end and a lower right end of the guide plate are fastened and fixed with bolts.

And the plate 130 serves as a cover to protect parts of the wrinkles forming part 150. The plate 130 is provided at the upper part of the wrinkles forming part 150.

Especially, the film collecting part 132 which collects the film P and transports the collected film P through the gap is located at the plate 130.

Further, the pair of walls 131 which transports the product without dropping out is provided at the two sides of the upper part of the plate 130.

FIG. 5 is a picture of the wrinkles forming part 150 of the present disclosure with the plate 130 removed. Inner parts of the wrinkles forming part 150 are clearly visible in FIG. 5.

Figure 6:
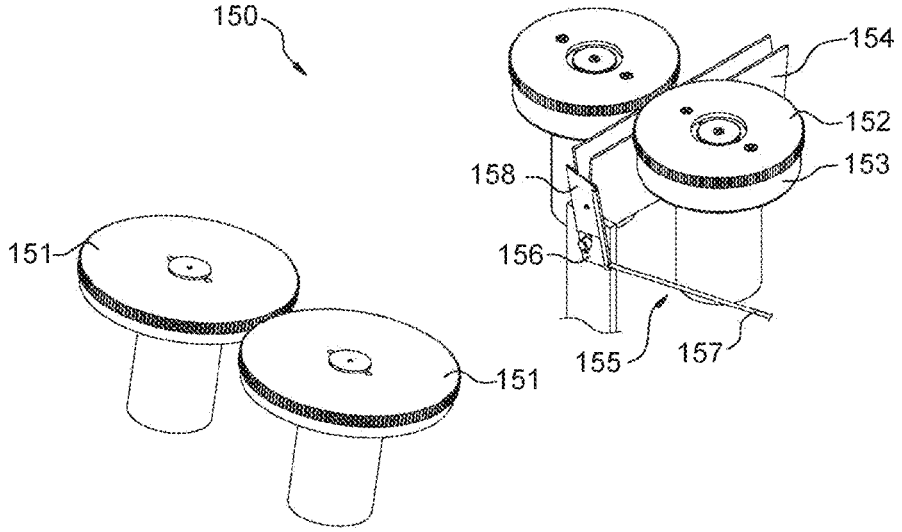
FIG. 6 depicts a perspective view of the wrinkles forming part of the present disclosure.

FIG. 6 is a perspective view of the wrinkles forming part 150 of the present disclosure. The technical advantages of the wrinkles forming part 150 of the present disclosure will be described below.

That is, film P transported by the guide former 120 wraps the product while passing through the pair of pulling rollers 151. At the same time, the pair of pulling rollers 151 pulls the film P downwards.

Herein, the pair of puling rollers 151 may be inclined downwards by about 10 to 20 degrees in order to tightly wrap the products (in this case, the paper cups) while pulling the film P downwards. Especially, the pair of sealing rollers 152 is characterized in that the height of the contact point of the pair of sealing rollers 152 is provided as higher than the height of the contact point of the pair of pulling rollers 151 in order to fold the film with triple zig-zag shapes.

The film P pulled downwards as described above passes through the pair of sealing rollers 152. Herein, the film P is transported upwardly by the height difference of FIG. 3, and as a result, the bottom of the center portion of the package is primarily folded (see 3rd figure in FIG. 9).

More specifically, when the film transported obliquely downwards is then transported obliquely upwards, the bottom of the center portion of the thin package is automatically folded in this process.

Thereafter, the sealing parts of the film (P) discharged through the pair of sealing rollers 152 are bonded by the heater 153 provided at a lower part of the pair of sealing rollers 152.

Herein, the film protecting member 154 in between the pair of sealing rollers 152 facilitates transportation of the film P while preventing the film P from melting or sticking due to heat from the sealing.

Especially, the center portion shape adjusting key 155 at an entrance of the pair of sealing rollers 152 operates selectively around the rotational axis of the hole 156*d*, such that the center portion shape adjusting key 155 contacts the lower surface of the film P and pushes the film P, thereby providing sealing on the center portion of the film P without defect.

Figure 9:
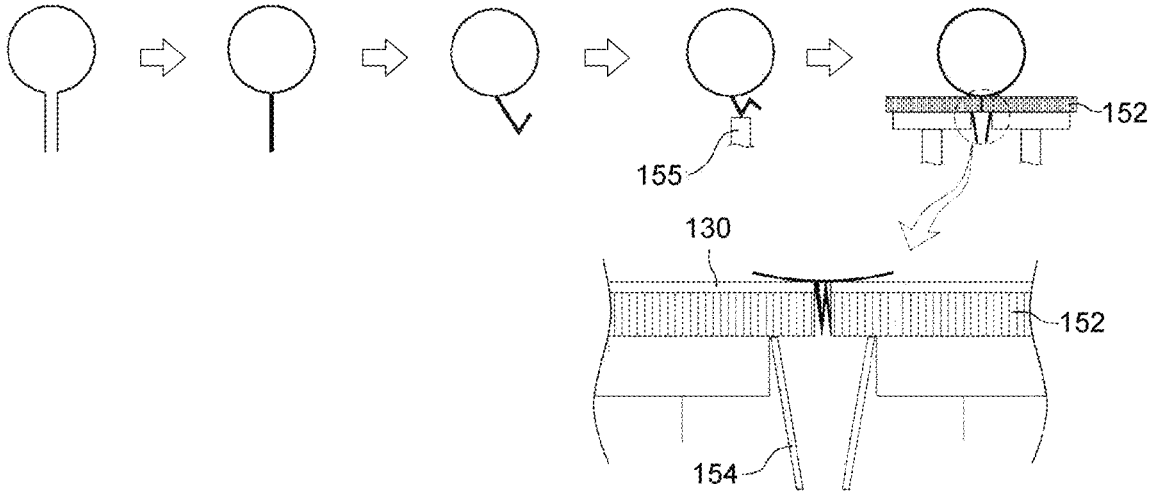
FIG. 9 shows states of forming wrinkles on the center portion of a product package.

That is, the operator performs adjustment of the height or the angle by selectively operating the grip 157 of the center portion shape adjusting key 155 such that the upper surface of the main body 156 or the auxiliary body 158 of the center portion shape adjusting key 155 contacts the lower surface of the film P, thereby folding the film with triple zig-zag shapes automatically (see fourth figure of FIG. 9).

Figure 8:
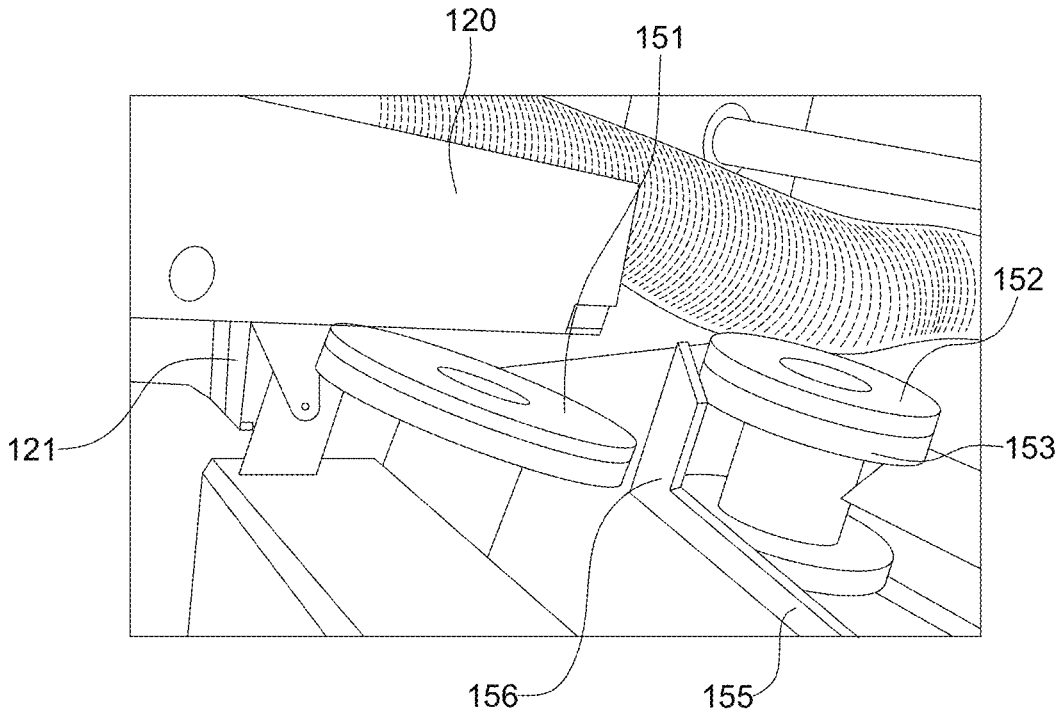
FIG. 8 presents a picture of the wrinkles forming part of the present disclosure.

On the other hand, FIG. 8 is a picture of the wrinkles forming part 150 of the present disclosure. The packaged paper cups are shown in FIG. 8.

FIG. 9 shows states of forming wrinkles on the center portion of the product package.

That is, the first figure of FIG. 9 shows that the left and right sides of the bottom of the center portion of the package are matched in two layers, the second figure of FIG. 9 shows that the left and right are combined, and the third and fourth figures of FIG. 9 show the process of folding the center portion as described above.

Finally, the fifth figure of FIG. 9 shows the center portion being sealed by the pair of sealing rollers 152.

Figure 10:
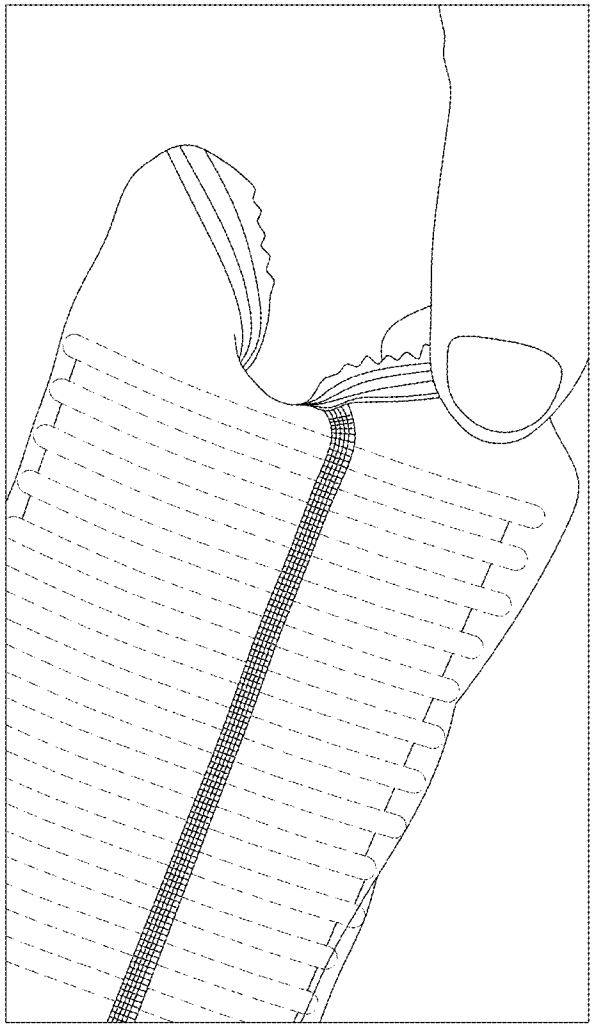
FIG. 10 is a picture of the product package of the present disclosure.

FIG. 10 is a picture of a product package of the present disclosure.

The present disclosure is a greatly useful disclosure, since it tightly wraps the product and prevents tearing or bursting so that it minimizes defects of the package.

INDUSTRIAL AVAILABILITY

The technical idea of the pillow type packaging machine for sealing triply the center portion of the film of the present disclosure may actually be repeated to obtain the same results, and in particular, by implementing the present disclosure, the technical development may be promoted and industrial development may be sufficiently protected.

What is claimed is:

1. A pillow type packaging machine 100 for sealing triply a center portion of a film P, which automatically packages products, the pillow type packaging machine 100 comprising:

a plurality of film supply rollers 110, located at an input end of the pillow type packaging machine 100, which unwind the roll film P and transport the unwound roll film P;

a guide former 120 which receives the unwound roll film P from the film supply rollers 110 and tightly rolls and wraps the film P to fit sizes of the products;

a wrinkles forming part 150 which receives the film P from the guide former 120 and is operated by driving a driving part 160 such that the center portion of the film P is automatically stacked with multiple zig-zag shapes to form wrinkles on the center portion of the film P, thereby carrying out a packaging operation without defect;

cutting rollers 140, located at an output end of the pillow type packaging machine 100, which cut packages discharged after the wrinkles are formed on the center portion of the film P, while sealing the packages and wherein the wrinkles forming part 150 includes: a pair of puling rollers 151 which tightly wraps the products to be packaged while pulling the received film P downwards: and a pair of sealing rollers 152 which receives the film P from the pair of pulling rollers 151 and bonds a lower part of the center portion of the film P while transporting the film P, wherein the pair of sealing rollers 152 is provided with a pair heaters 153 at a lower part thereof.

2. The pillow type packaging machine 100 of claim 1, wherein the pair of puling rollers 151 are inclined downwards in order to tightly wrap the products while pulling the film P downwards, wherein a height of a contact point between the pair of sealing rollers 152 is higher than a height of a contact point between the pair of pulling rollers 151, and wherein the pair of sealing rollers 152 are positioned horizontally such that the triply sealed center portion is prevented from disengaging from the contact point between the pair of sealing rollers 152.

3. The pillow type packaging machine 100 of claim 1, wherein the wrinkles forming part 150 further includes: a heat-resistant film protecting member 154 in between the pair of sealing rollers 152, wherein the heat resistant film protecting member 154 facilitates transportation of the film P and protects the center portion of the film P from heat.

4. The pillow type packaging machine 100 of claim 1, wherein the wrinkles forming part 150 further includes: a center portion shape adjusting key 155 at an entrance of the pair of sealing rollers 152, wherein the center portion shape adjusting key 155 operates to adjust a height or an angle of a main body 156 or an auxiliary body 158 selectively around a rotational axis inserted into a hole 156*d* according to an operation of a grip 157 such that the center portion shape adjusting key 155 contacts a lower surface of the film P and pushes the film P, thereby providing sealing on the center portion of the film P without defect.

* * * * *